United States Patent [19]

Becker

[11] 4,124,950

[45] Nov. 14, 1978

[54] ACTION TOY

[75] Inventor: James R. Becker, Kings Point, N.Y.

[73] Assignee: Kohner, Inc., New York, N.Y.

[21] Appl. No.: 822,854

[22] Filed: Aug. 8, 1977

[51] Int. Cl.[2] ..... A63H 17/18

[52] U.S. Cl. ..... 46/109; 46/204

[58] Field of Search ..... 46/109, 106, 107, 110, 46/97, 99, 101, 103, 156, 126, 204

[56] References Cited

U.S. PATENT DOCUMENTS

| | | | |
|---|---|---|---|
| D. 156,658 | 12/1949 | Rahn | 46/109 X |
| 1,599,965 | 9/1926 | Heimer | 46/107 |
| 1,623,039 | 4/1927 | Babbitt | 46/110 |
| 1,626,756 | 5/1927 | Recatti | 46/220 X |
| 2,760,303 | 8/1956 | Del Mas | 46/163 X |

*Primary Examiner*—Louis G. Mancene
*Assistant Examiner*—Mickey Yu
*Attorney, Agent, or Firm*—Seidel, Gonda & Goldhammer

[57] ABSTRACT

An action toy comprising a frame and a toy figure mounted thereon. The frame is provided with a fork. A crank is rotatably mounted on the fork. A wheel is disposed within the fork and mounted on the crank for rotation therewith. At least one shoe-shaped pedal is rotatably mounted on the crank. An elastomeric member is coupled to the pedal and to the toy figure. When the wheel is caused to rotate, the elastomeric member flexes and stretches and the pedal performs a pitching movement to simulate a pedalling action.

5 Claims, 6 Drawing Figures

ACTION TOY

BACKGROUND OF THE INVENTION

The present invention is directed to an action toy. In particular, the invention is directed to an action toy which may be easily manipulated by a child and which, when moved, simulates action on the part of a toy figure.

An advantage of the invention is that it is easily manipulable by a child to provide an action effect.

Another advantage of the invention is that it is of relatively simple construction.

A further advantage of the invention is that it is sturdy and wear-resistant.

Other advantages appear hereinafter.

BRIEF SUMMARY OF THE INVENTION

An action toy comprising a toy figure and an elastomeric member coupled to the figure. A motive means is coupled to the elastomeric member. The motive means facilitates movement of the toy and causes deformation of the elastomeric member to simulate action.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
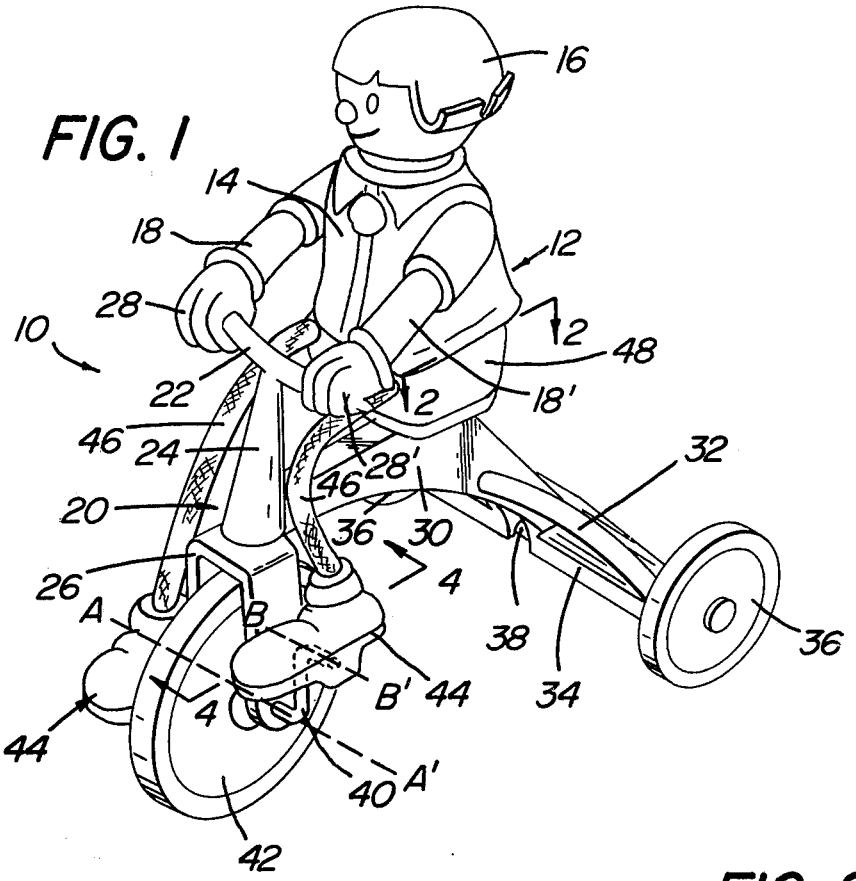
FIG. 1 is an isometric of an action toy constructed in accordance with the principles of the present invention.

Referring to the drawings in detail wherein like numerals indicate like elements, there is shown in FIG. 1 an action toy 10 in accordance with the present invention. The action toy comprises a toy figure 12 having an upper section 14. A head 16 and arms 18, 18′ are secured to the upper section 14 by any suitable conventional means such as adhesive. The upper section 14, head 16 and arms 18, 18′ are preferably made of a plastic polymeric material.

As shown in FIG. 1, the toy figure 12 is mounted on a motive means 20 such as a tricycle. The motive means, however, could take the form of any other wheeled device such as a bicycle or it could take the form of any other device which can be operated by a child to perform movement. The motive means 20 includes a single piece construction of a handlebars 22, shaft 24 and fork 26. Arms 18, 18′ are respectively provided with hands 28, 28′ each of which has an aperture which receives an end portion of the handlebars 22. The hands 28, 28′ are secured to the handlebars 22 by means of an adhesive or the like. The single piece construction of the handlebars 22, shaft 24 and fork 26 is preferably made of a plastic polymeric material.

The motive means 20 also includes a single piece construction of a support member 30, a pair of identical stays 32 (only one of which is shown in FIG. 1), and a step 34. The single piece construction of the support member 30, stays 32 and step 34 is preferably made of a polymeric plastic material and is secured to the shaft 24 by adhesive or the like.

A pair of wheels 36, 36′ are mounted on an axle 38. The axle 38 is rotatably mounted on the step 34 and is generally hidden from view by the step. Preferably, the wheels 36, 36′ are press fitted on the axle 38 so that the wheels and axle rotate together. Wheels 36, 36′ are preferably made of a polymeric plastic material.

Figure 6:
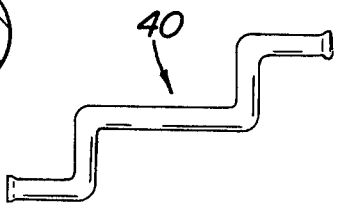
FIG. 6 is a front view of the crank.

A crank 40 is rotatably mounted on the fork 26. The crank 40 is a symmetrical single piece construction as shown in FIG. 6. A wheel 42 is friction fitted on the crank 40 so that the crank and wheel rotate together. The wheel 42 is mounted on the crank within the fork 26.

A pair of pedals 44, 44′, in the shape of shoes, are rotatably mounted on opposite ends of the crank 40. See FIG. 1. The pedals may be made of a plastic polymeric material. Each of the pedals 44, 44′ describe a circle of rotation as the crank 40 rotates about the axis A–A′. Each of the pedals 44, 44′ also performs a pitching motion with respect to the axis of rotation aligned with the end portion of the crank on which the pedal is mounted. One such axis of rotation is shown by the dotted line B–B′ in connection with pedal 44 in FIG. 1.

Figure 2:
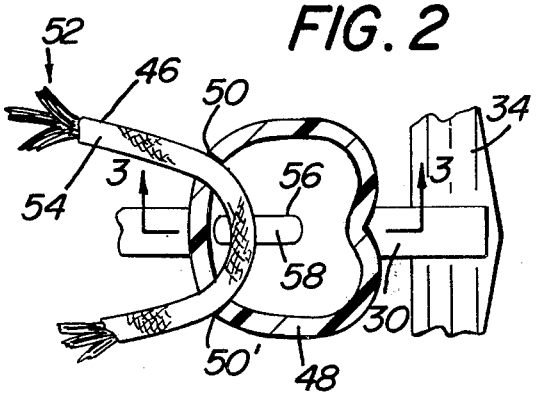
FIG. 2 is a cross-sectional view taken along the lines 2—2 in FIG. 1.

The pedals 44, 44′ are coupled to the ends of an elastomeric member 46 as will be described more fully hereinafter. Elastomeric member 46 is coupled to a lower section 48 of toy figure 12 by wedging the elastomeric member in a pair of notches 50, 50′ in the lower section. See FIG. 2. The lower section is secured to the upper section 14 by adhesive or the like. The elastomeric member is pinched in place at the notches 50, 50′. Preferably, the elastomeric member comprises a bundle of rubber strips 52 packed within a woven fabric sleeve 54 which can flex and stretch with the rubber strips.

Figure 3:
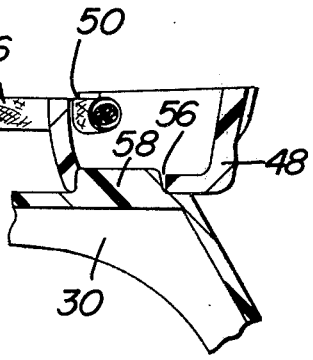
FIG. 3 is a cross-sectional view taken along the lines 3—3 in FIG. 2.

The lower section 48 of toy figure 12 is provided with a slot 56. See FIG. 3. The lower section 48 is secured to the top of the support member 30 by means of a rib 58 which fits within the slot 56. Adhesive may be applied to the rib 58 and interior of the slot 56 to further prevent the lower section 48 from being detached from support member 30.

Figure 4:
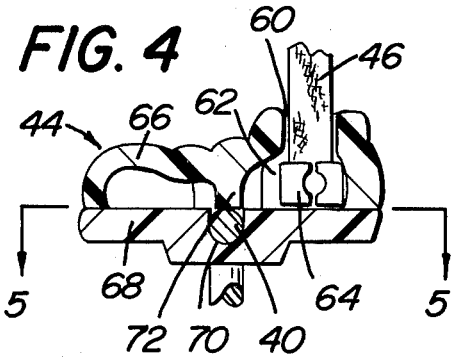
FIG. 4 is a cross-sectional view taken along the lines 4—4 in FIG. 1.

The ends of elastomeric member 46 are secured to pedals 44, 44′. The method of coupling the elastomeric member to each pedal is the same. The structure of each pedal is also the same. Accordingly, the method of coupling the elastomeric member to pedal 44 only is described herein. Elastomeric member 46 extends through a passage 60 in pedal 44. See FIG. 4. The passage 60 communicates with a chamber 62 within the pedal. The end of the elastomeric member is pinched by a clip 64 which does not fit through the passage 60. The clip retains the end of the elastomeric member within chamber 62.

Preferably, the pedal 44 comprises a top portion 66 and a bottom portion 68. See FIG. 4. The top and bottom portions are secured together by means of adhesive or the like. The bottom portion 68 is provided with a lateral groove 70 within which the end portion of the crank 40 is seated. A partition 72 in the top portion 66 of the pedal keeps the crank 40 seated within the groove 70.

Figure 5:
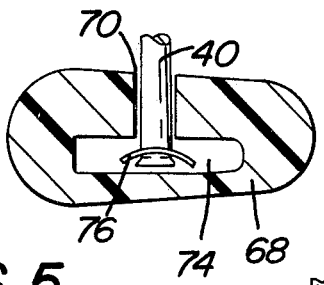
FIG. 5 is a cross-sectional view taken along the lines 5—5 in FIG. 4.

The bottom portion 68 of the pedal is provided with an elongated recess 74 which communicates with groove 70. See FIG. 5. The end of crank 40 protrudes within the recess 74. A concave washer 76 is mounted on the end of the crank 40. The end of the crank 40 is deformed by pinching to prevent separation of the washer from the crank. The washer 76 is wider than the groove 70. Accordingly, the washer retains the end of the crank within recess 74.

In operation, a child grasps the action toy 10 and imparts motion to the toy by moving the wheels 36, 36' and 42 against a supporting surface. Wheel 42 rotates in contact with the supporting surface causing crank 40 to rotate about the axis A–A'. The shoe-shaped pedals 44, 44' describe circles of rotation about the axis A–A'. The elastomeric member 46 flexes and stretches as the pedals describe their circles of rotation. In addition, the pedals 44, 44' perform a pitching movement with respect to the crank 40 under constraint of the elastomeric member 46. The flexing and stretching of the elastomeric member simulates the bending and extension of the human leg in pedaling a wheeled object such as a tricycle. The pitching movement of the shoe-shaped pedals 44, 44' simulates the movement of the human foot in pedaling the tricycle.

As used herein, the term "motive means" signifies means for transmitting power from a source to the pedals 44, 44' and elastomeric member 46. The source of power can be the child or a conventional device such as a wound spring. Additionally, although the elastomeric member 46 has been described as representing the legs of the toy figure 12, it should be obvious that the member could also be used as the arms of a toy figure. In that case, the motive means would be coupled to the elastomeric member to cause flexing and stretching of the member in simulation of the bending and extension of a human arm. Although the action toy has been described in terms of a wheeled vehicle such as a tricycle, the invention is not limited to such forms but includes all motive means coupled to an elastomeric member or the equivalent thereof to simulate movement of the human anatomy as described above.

The present invention may be embodied in other specific forms without departing from the spirit or essential attributes thereof and, accordingly, reference should be made to the appended claims, rather than to the foregoing specification as indicating the scope of the invention.

I claim:

1. An action toy including a crank shaft and a motive member for imparting rotary motion to the shaft, comprising:

a toy figure, an elastomeric member fixedly coupled at one end to said toy figure, pedal means rotatably mounted on said crank shaft for performing a pitching movement as said crank shaft is rotated, said pedal means having a chamber, a lateral groove which opens into a recess transverse thereto, and a partition disposed above said groove, said crank shaft having an end portion which is seated in said groove, said end portion terminating in said transverse recess and having a washer mounted thereon, whereby said partition and washer retain said crank shaft end portion within said groove and recess, said elastomeric member being anchored at another end inside said pedal means chamber whereby said elastomeric member stretches and flexes between said anchored end and said end fixedly coupled to said toy figure.

2. The action toy according to claim 1 wherein said pedal means is in the shape of a shoe.

3. An action toy, comprising:

a frame provided with a fork, a toy figure mounted on said frame, a wheel at least partly disposed within said fork and mounted on said crank for rotation therewith, at least one pedal rotatably mounted on said crank, said pedal having a chamber, an elastomeric member fixedly coupled at one end to said toy figure and anchored at another end within said pedal chamber, said crank having an end portion disposed within said pedal, means disposed within said pedal for retaining said crank end portion within said pedal, and said pedal being provided with a groove and said end portion of said crank being seated in said groove.

4. The action toy according to claim 3 wherein said pedal is in the shape of a shoe.

5. The action toy according to claim 3 including a clip fastened to one end of said elastomeric member for anchoring said elastomeric member within said chamber.

* * * * *